US007651404B1

(12) United States Patent
Larson

(10) Patent No.: US 7,651,404 B1
(45) Date of Patent: Jan. 26, 2010

(54) SELECT PACE GOLF COURSE

(76) Inventor: Gerald Larson, 18977 NW. 23rd Pl., Pembroke Pines, FL (US) 33029

( * ) Notice: Subject to any disclaimer, the term of this patent is extended or adjusted under 35 U.S.C. 154(b) by 0 days.

(21) Appl. No.: 12/156,854

(22) Filed: Jun. 5, 2008

(51) Int. Cl.
*A63B 67/02* (2006.01)

(52) U.S. Cl. ..... 473/169; 473/409

(58) Field of Classification Search ..... 473/167–170, 473/409
See application file for complete search history.

(56) References Cited

U.S. PATENT DOCUMENTS 3,083,021 A * 3/1963 Reilly ..... 473/169
3,719,360 A 3/1973 Purdy
4,145,053 A 3/1979 Healey
4,157,831 A * 6/1979 Renn ..... 473/169
4,225,136 A 9/1980 Beam
4,798,385 A 1/1989 Tegart
4,872,686 A 10/1989 Trasko
4,988,105 A 1/1991 Perry
5,265,875 A 11/1993 Fitzgerald
5,431,402 A 7/1995 Aguilera
6,036,606 A * 3/2000 Dumas ..... 473/169
6,053,819 A 4/2000 Wilk
2005/0096143 A1 * 5/2005 Anton et al. ..... 473/169

* cited by examiner

*Primary Examiner*—Mark S Graham

(57) ABSTRACT

A full-sized outdoor golf course is described with any number of holes, usually 18 or 36 holes. Each hole is made up of a tee, a fairway, and a green. The holes are laid out in a pattern that makes it practical for each group of players on the golf course to play the holes in random order. This is accomplished by organizing the holes in a pattern that greatly increases the number of tees that are available to pick from after leaving any green on the course. All tees and greens, and only tees and greens, but no fairways, are located along special cart paths (44, 46, 48, 49, 50), that run roughly perpendicular to the normal cart paths that usually run along each fairway, so that when finishing play on any green, several tees are reachable by golf cart in a relatively short predetermined time, preferably 1½ minutes or less, using the special cart paths (44, 46, 48, 49, 50).

8 Claims, 3 Drawing Sheets

SELECT PACE GOLF COURSE

CROSS-REFERENCE TO RELATED APPLICATIONS

Not applicable

FEDERALLY SPONSORED RESEARCH

Not applicable

SEQUENCE LISTING OR PROGRAM

Not applicable

BACKGROUND

1. Field of Invention

This invention relates to outdoor golf courses, specifically to a new course concept and method of playing golf.

2. Prior Art

Conventional golf courses are laid out with the holes following one another in sequential manner to more or less fit well into the terrain of the land on which they are built. They are designed to be played in sequential manner from hole 1 through hole 18 (on an 18 hole course). When players finish playing one hole, there is normally only one nearby tee to go to next, which is the next sequential hole number.

It is commonly known that the main complaint of golfers is the pace of play, which is usually the pace of the slowest group on the golf course. The pace is often 5 hours or more.

This complaint stems from the fact that the holes on conventional courses are designed for and played in sequential order and cannot practically be played in random order. This is because most tee areas are an entire fairway away from other tees or would necessitate crossing over other fairways, which may be in use, in order to reach them. This makes it too time consuming, confusing, dangerous, frustrating, and disruptive to other players, to allow playing the holes in random order. In other words, it would be chaotic. Someone skilled in the art would know that random order of play would not be allowed on a standard golf course on which most holes are occupied by players. Just the occasional nearness of more than one tee area, that may or may not be open, would not be enough to make it practical. Players that are stuck behind a slow group might have to travel the length of many fairways in order to hopefully find an open tee and fairway. That would defeat the purpose of trying to play a faster round of golf.

Most golf courses attempt to alleviate the pace of play problem by having rangers or marshals drive around the course. The rangers try to encourage slower groups to play faster. This has very limited success. Despite their best efforts, the pace of play is often still over 5 hours because of the inability of some groups to play any faster.

U.S. Pat. No. 3,719,360 to Purdy (1973) shows a golf course arranged radially around a central clubhouse area, made up of several 3 hole sets. This course is designed for the holes to be played sequentially as on a conventional course. It does not have multiple tees accessible after golfers leave each green. It would not be practical to play the holes in random order.

U.S. Pat. No. 4,872,686 to Trasko (1989) describes a golf course that requires hitting tee shots for 3 separate holes before hitting the second shot on each hole. Each playing group must play sequentially one after the other. Faster groups would have to wait a considerable time for slower groups in front of them.

U.S. Pat. No. 6,053,819 to Wilk (2000) describes a golf park with one or more golf courses. Each course is comprised of a single fairway with multiple tees and multiple greens. A single group of players plays up and down the one fairway using the multiple tees and greens for a predetermined period of time. If groups play for a normal 4 to 4½ hour time period, only two groups could play each one-hole course in a day. A park with eighteen one-hole courses of this type would have many more greens to maintain than a conventional 18 hole course.

Several compact types of golf courses have been proposed for example, in U.S. Pat. Nos. 4,988,105 to Perry (1991), 4,225,136 to Beam (1980), 5,431,402 to Aguilera (1995), 5,265,875 to Fitzgerald (1993), 4,798,385 to Tegart (1989), and 4,145,053 to Healey (1979). These are compact courses, not full-length courses. Although they may reduce the amount of time needed to play and the amount of land needed, they are definitely not like playing golf on a full-length course. They do not provide the experience of playing 18 uniquely designed golf holes, with a variety of different greens, fairways, hazards, and landscaping.

SUMMARY

In accordance with one embodiment, a golf course comprises several sets of six holes, each set having 3 holes leading one after the other away from the starting end of the course and 3 holes leading back to the starting end and being roughly parallel to the first 3, but not necessarily adjacent to them. This pattern continues up to the total number of holes and results in the golf course being divided into 3 sections with each section containing one-third of the holes. Each section is one hole in depth and a plurality of holes in width. The holes in each section are of various lengths. Special "crossing" cart paths run between the 3 sections and across the ends of the course, resulting in all of the tees and greens, an only tees and greens but no fairways being adjacent to these special "crossing" cart paths. These special "crossing" cart paths run in a continuous manner across the entire width of each section without being interrupted by any fairway crossing them. These special "crossing" cart paths are in addition to normal cart paths that may run beside the fairways of the golf course. This layout substantially increases the number of tees easily accessible to players after they finish putting on any green, making it quick, easy, safe, and practical to efficiently play the holes in a random order, allowing faster players to easily bypass slower players by having frequent easy access to several nearby tees without having to travel the length of any fairway to get to them, without having to cross any fairway and without disturbing any other players on the course.

DRAWINGS

Figures

DRAWINGS

Reference Numerals

Figure 1:
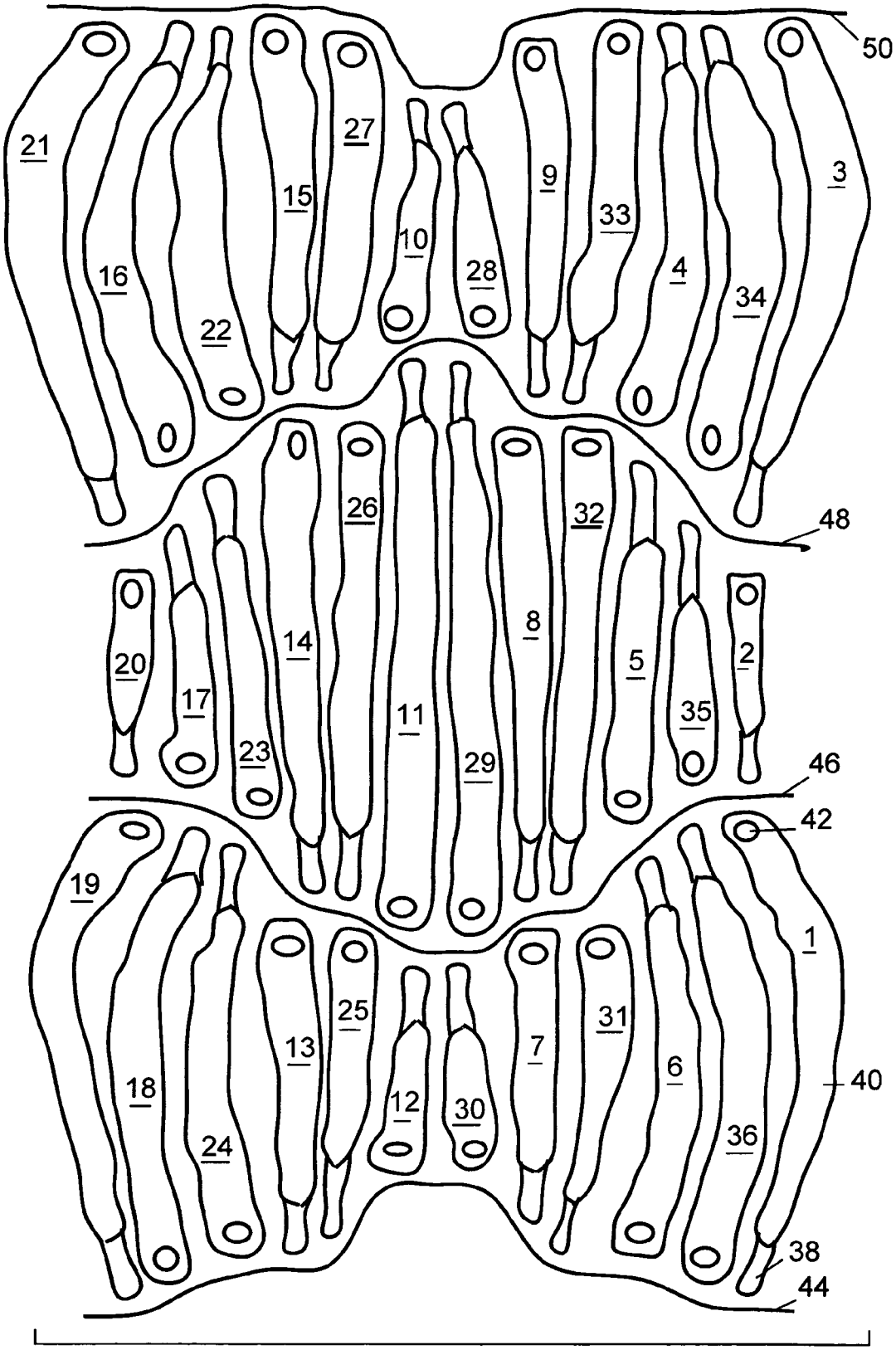
FIG. 1 shows a 36 hole outdoor golf course divided into 3 sections.

1 entire first hole comprised of a tee area, a fairway, and a green

2-18 holes 2 through 18 of the golf course

19-36 holes 19 through 36 of the golf course

38 tee area of first hole

40 fairway of first hole

42 green of the first hole
44 cart path along starting end of golf course
46 cart path between first and second section of golf course
48 cart path between second and third section of golf course
49 cart path between third and fourth section of golf course
50 cart path along the far end of the golf course

DETAILED DESCRIPTION

FIG. 1—The Preferred Embodiment

One embodiment of the golf course is illustrated in FIG. 1. It shows a thirty-six hole golf course, comprised of holes 1 through 36, which is made up of two eighteen-hole courses. The term "hole" is used herein to define the combination of a tee 38, a fairway 40, and a green 42 as shown in FIG. 1 at hole 1. The holes are all arranged in a pattern of six hole sets. Each six hole set has three holes going away from the starting end of the course such as hole 1 through hole 3. Hole 3 terminates with a green adjacent to the far end of the golf course away from the starting end. The next three holes, hole 4 through hole 6, return to the starting end of the golf course and are roughly parallel to the first three holes, but not necessarily adjacent to them. Hole 6 terminates with a green adjacent to the starting end of the course. This pattern of six hole acts is repeated for all thirty-six holes. This pattern of hole placement results in the entire course being divided into three sections, with each section being one hole in depth and 12 holes in width, as shown in FIG. 1. The holes in each section are of various lengths.

Besides possibly having normal cart paths running along each fairway (these paths are not shown), there are four additional cart paths, 44, 46, 48, and 50 as shown in FIG. 1. Cart path 44 runs along the starting end of the course. Cart path 46 runs between two sections. Cart path 48 runs between two sections. Cart path 50 runs along the far end of the course away from the starting end. This results in all tees and greens, and only tees and greens being located adjacent to these special "crossing" cart paths. There are no fairways with their long axis located adjacent to these particular cart paths.

The course could have lakes, streams, sand traps, trees, and other landscaping (none of these shown here) added as desired. The course would normally have some changes in elevation (not shown here) between tees, fairways and greens.

Operation

FIGS. 1, 2, 3

The manner of playing golf on the applicant's golf course is generally the same as for conventional courses in present use. Namely, one plays each individual hole in a conventional manner. When players are finished playing an individual hole, they often do not have to proceed to the next sequential tee as on a conventional course. They can often select their next tee from one or more open tees that are easily accessible on cart paths 44, 46, 48, 49, and 50. These particular cart paths are different than the usual cart paths that are mainly for driving a golf cart from a tee area to a green area. These particular cart paths are for making many tee areas accessible quickly, and safely without having to drive the length of any fairway or crossing over any fairway. All of the tees and greens are located along these cart paths. No fairways have their long axis adjacent to these cart paths. Faster players can bypass slower players by playing the holes out of sequential order. As shown in FIG. 1, when a group of players finishes putting on the green 42 of hole 1, they can easily reach the tees of holes 2, 36, 6, 32, 8, 30, and 12 along cart path 46. If necessary, they could even pick an open tee of holes 26, 14, 24, 18, or 20 which are further along cart path 46. A method such as GPS (Global Positioning System), available on the golf carts at many courses today, would be used by the players to select an open tee from a list of open tees. The GPS system can track the location of all golf carts on the golf course.

FIGS. 2-3

Additional Embodiments

Figure 2:
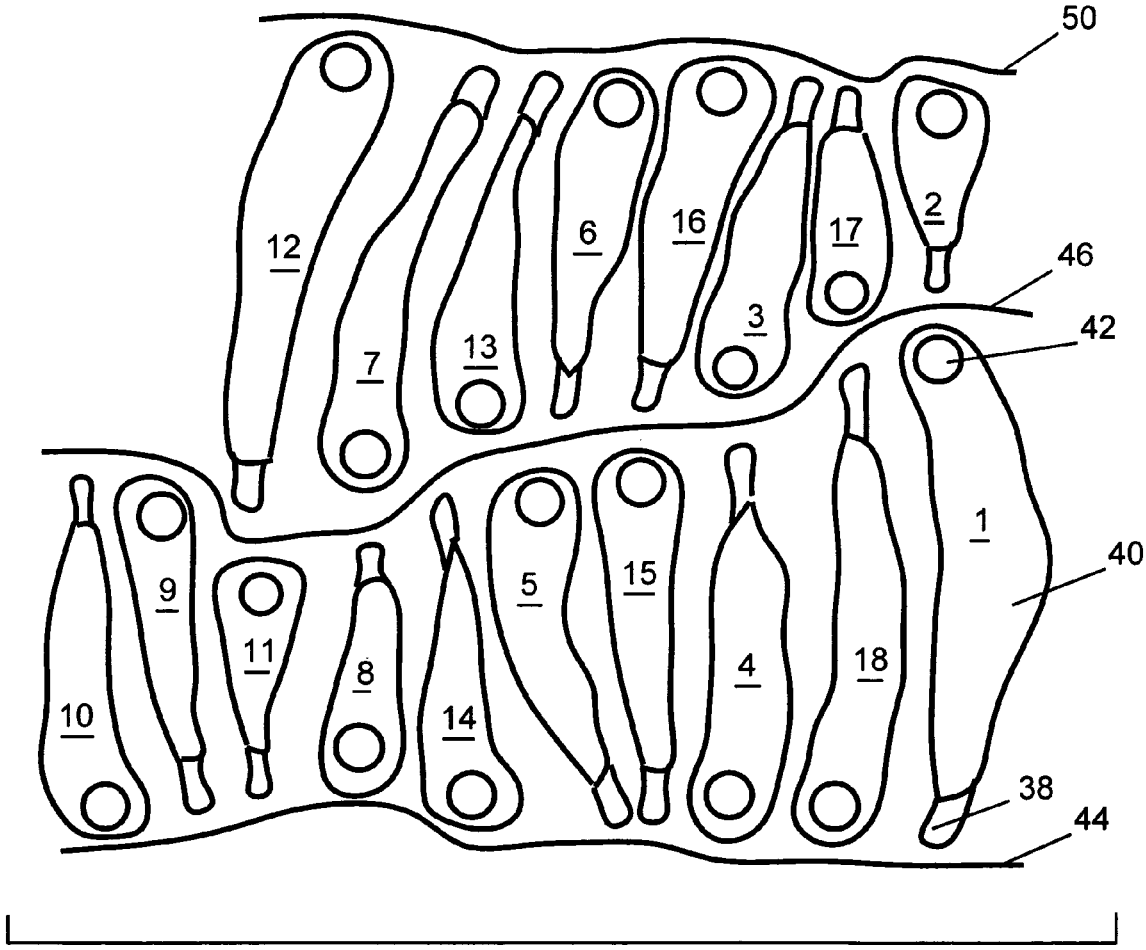
FIG. 2 shows an 18 hole outdoor golf course divided into 2 sections.
Figure 3:
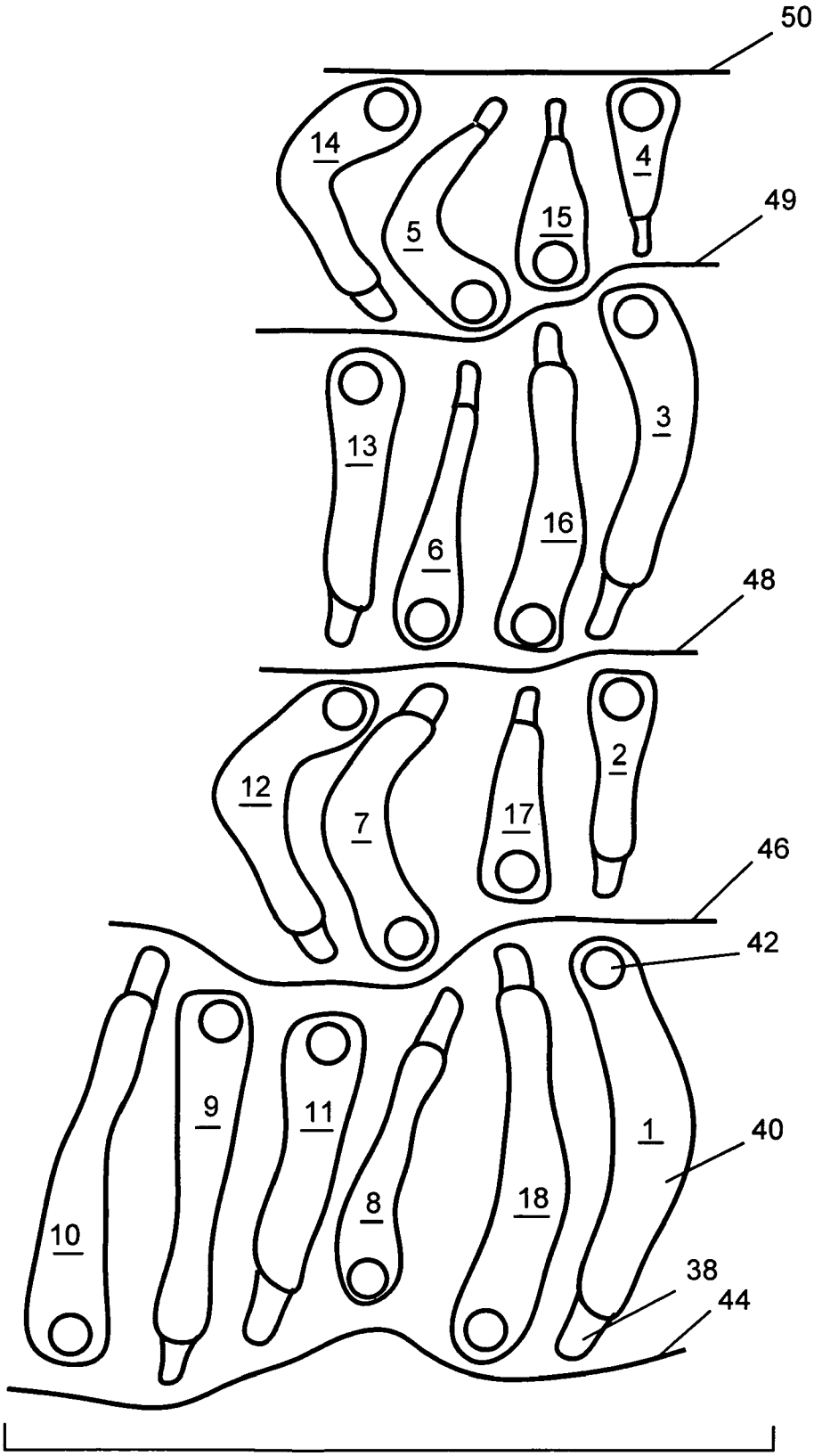
FIG. 3 shows an 18 hole outdoor golf course divided into 4 sections.

Additional embodiments are shown in FIGS. 2 and 3. FIG. 2 shows an eighteen hole golf course with the holes arranged in a pattern of four hole sets. Each four hole set has two holes going away from the starting end of the course such as hole 1 and hole 2. The next two holes, hole 3 and hole 4, return to the starting end of the course and are roughly parallel to the first two holes, but not necessarily adjacent to them. This pattern of four hole sets is repeated for most of the holes. In this embodiment, hole 9 and hole 10 are arranged in a one hole out and one hole back pattern in order to ensure that the green of hole 18 is located at the starting end of the course. These two holes are an exception to the pattern of four hole sets.

FIG. 3 shows an eighteen hole golf course with the holes arranged in a pattern of eight hole sets. Each eight hole set has four holes going away from the starting end of the course such as hole 1 through hole 4. The next four holes, hole 5 through hole 8, return to the starting end of the course and are roughly parallel to the first four holes, but not necessarily adjacent to them. This pattern of eight hole sets is repeated for most of the holes. This embodiment shows cart path 49 between the third and fourth sections of the golf course. In this embodiment, hole 9 and hole 10 are arranged in a one hole out and one hole back pattern in order to ensure that the green of hole 18 is located at the starting end of the course. These two holes are an exception to the pattern of eight hole sets.

ADVANTAGES

From the description above, a number of advantages of some embodiments of my personal pace golf course become evident:

(a) The accessibility of multiple tees after leaving each green permits the holes to be played in random order, thus allowing each group of golfers to play at their own pace. Faster players do not have to wait for slower players ahead because they can easily bypass them by playing the holes out of the normal sequential order. Conventional golf courses are all designed for the holes to be played in sequential order, therefore they all have the problem that the slowest group of players on the course sets the pace of play for all groups behind them. The pace of play on conventional courses is often 5 hours or more. The embodiment of my golf course makes it possible for groups to play at whatever pace they are capable of playing, such as 2, 3, or 4 hours or any time in between. Threesomes, twosomes and single players are usually faster than foursomes.

(b) Beverage carts on the course can drive past all tees and greens by staying on the four additional cart paths (44, 46, 48, 50) as shown in FIG. 1, and do not have to drive up and down the fairways to service the players. Players have access to the beverage cart only when they are between holes and thus do not hold up any players behind them while being served.

(c) Players of less ability such as beginners are not intimidated by faster players having to wait behind them. Slower players, if they prefer, can easily pick the shorter holes to play and skip the longer ones in order to finish 18 holes in a more reasonable time.

CONCLUSIONS, RAMIFICATIONS, AND SCOPE

Thus, the reader will see that at least one of the embodiments provides a way to resolve the pace of play problem found on conventional golf courses.

The reason that this course can be played in random order is because it is designed to greatly increase the number of tees that are easily accessible after leaving any green. On a 36 hole course of these embodiments, when a group of players finishes putting on any green, they then have several tees along the cart path they are on (44, 46, 48 or 50 in FIG. 1) that are accessible within approximately a 1 minute drive by golf cart. The tees are quick and easy to get to because there are no fairways adjacent to these particular cart paths, only tees and greens. One or more of them will normally be open. An open tee is defined herein as a tee and the fairway area of the same hole, not occupied by any player. A 36 hole course or 42 hole course, for example, makes it easy for a group to play 18 holes in a non sequential order without having to repeat a hole. They can play a variety of long and short holes that add up to whatever total par they want, such as 70 or 72.

A method such as the GPS system, installed in the golf carts at many golf courses today, can be used to inform each group as to what tees are open at any time. To prevent overcrowding and ensure that there will always be enough open tees on the course to make non sequential order of play feasible, starting time intervals can be adjusted to be a little longer than normal, possibly 11 minute intervals. Also, faster players are able to finish a golf course of these embodiments much faster than on a conventional course, and that will also help to create more open tees.

On a golf course of these embodiments, players do not have to play in a non sequential order. The holes are numbered sequentially as shown in FIG. 1 so that they can be played in sequential order if desired. The course can be designated for play in sequential order on special occasions, such as when it is reserved for a "shotgun start" for a large group or for tournaments.

On a 36 hole course of one embodiment, the holes of the two 18 hole courses could be intertwined or could be two adjacent 18 hole courses. Additional holes could be added to the embodiments, for example, a 42 hole course could be made up of two 18 hole courses plus 6 additional holes in the center, roughly parallel to the other holes. If the two 18 hole courses are designated for sequential play on any day, the additional 6 holes could be used by a professional to give playing lessons or used for any other purpose. The 6 additional holes would add to the number of available tees during random order of play.

The embodiments described above are merely illustrative and many changes and modifications can be made without departing from the scope of the invention. For example, the shape of the holes, the length of the holes, and the number of holes could be varied as desired.

Thus the scope of the embodiment should be determined by the appended claims and their legal equivalents, rather than by the examples given.

I claim:

1. An outdoor golf course divided into a predetermined number of sections that are one hole in depth and are a plurality of said holes side by side in width, with each said hole having a tee area, a fairway area and a green, and with said holes within each said section being of various lengths, wherein substantially all said holes within each said section are roughly parallel to each other and including cart paths between said sections and along the starting end and far end of said course that run roughly perpendicular to said fairways, and with all said tees and greens located adjacent to said cart paths, and only said tees and greens being located adjacent to said cart paths, but no said fairways being located adjacent to said cart paths, and with said cart paths being continuous the entire width of each said section without interruption, and without any said fairways crossing said cart paths, thereby making a plurality of said tees quickly and easily accessible to choose from after finishing play on any said green, whereby each group of players on said golf course are able to safely play said holes in random order, so that faster said players can easily bypass slower said players, by quickly, easily and safely selecting the first available open nearby said tee from a plurality of easily accessible nearby said tees, after leaving any said green, without traveling the length of any said fairways that are in use by other said players, in order to bypass other said players, and without crossing any said fairways that could have other said players on them.

2. The outdoor golf course of claim 1 wherein said holes are grouped into 2 said sections.

3. The outdoor golf course of claim 1 wherein said holes are grouped into 3 said sections.

4. The outdoor golf course of claim 1 wherein said holes are grouped into 4 said sections.

5. A method of playing an outdoor golf course, comprising:

(a) providing a plurality of holes grouped into a predetermined number of sections, said sections being one hole in depth and a plurality of holes side by side in width, each said hole having a tee area, a fairway area and a green, wherein substantially all said holes within each said section are roughly parallel to each other, (b) providing cart paths located between said sections and along the starting end and far end of said course that run roughly perpendicular to said fairways, and with said cart paths being continuous the entire width of each said section without interruption, and without any said fairways crossing said cart paths.

(c) providing all said tees and greens of said holes located adjacent to said cart paths, and only said tees and greens being located adjacent to said cart paths, but no said fairways being located adjacent to said cart paths, so that a plurality of said tees are quickly and easily accessible to choose from after finishing play on any said green, whereby each group of players on said golf course are able to play said holes in random order, so that faster said players can easily bypass slower said players, by quickly, easily and safely selecting the first available open nearby said tee from a plurality of easily accessible nearby said tees, after leaving any said green, without traveling the length of any said fairways that are in use by other said players, in order to bypass other said players, and without crossing any said fairways that could have other said players on them.

6. The method of claim 5 wherein said holes are grouped into 2 said sections.

7. The method of claim 5 wherein said holes are grouped into 3 said sections.

8. The method of claim 5 wherein said holes are grouped into 4 said sections.

* * * * *